US012759040B2

(12) United States Patent
Tsuchihashi et al.

(10) Patent No.: US 12,759,040 B2
(45) Date of Patent: Oct. 13, 2026

(54) COPPER POWDER

(71) Applicant: JX Advanced Metals Corporation, Tokyo (JP)

(72) Inventors: Reina Tsuchihashi, Ibaraki (JP); Hironori Orikasa, Ibaraki (JP)

(73) Assignee: JX Advanced Metals Corporation, Tokyo (JP)

( * ) Notice: Subject to any disclaimer, the term of this patent is extended or adjusted under 35 U.S.C. 154(b) by 133 days.

(21) Appl. No.: 18/560,990

(22) PCT Filed: Feb. 18, 2022

(86) PCT No.: PCT/JP2022/006770

§ 371 (c)(1),
(2) Date: Nov. 15, 2023

(87) PCT Pub. No.: WO2022/259630

PCT Pub. Date: Dec. 15, 2022

(65) Prior Publication Data

US 2024/0253113 A1 Aug. 1, 2024

(30) Foreign Application Priority Data

Jun. 8, 2021 (JP) ..... 2021-096205

(51) Int. Cl.
*B22F 1/054* (2022.01)
*B22F 9/04* (2006.01)
*B22F 9/24* (2006.01)

(52) U.S. Cl.
CPC ..... *B22F 1/054* (2022.01); *B22F 9/04* (2013.01); *B22F 9/24* (2013.01); *B22F 2301/10* (2013.01);

(Continued)

(58) Field of Classification Search
None
See application file for complete search history.

(56) References Cited

U.S. PATENT DOCUMENTS

2017/0145225 A1* 5/2017 Okada ..... C09C 1/02
2017/0152386 A1* 6/2017 Okada ..... B22F 1/06

(Continued)

FOREIGN PATENT DOCUMENTS

JP H113618 A * 1/1999
JP 2014-221927 A 11/2014

(Continued)

OTHER PUBLICATIONS

English machine translation of JP 2017-039990, patents.google.com, accessed Mar. 12, 2025.*

(Continued)

*Primary Examiner* — Xiaobei Wang
(74) *Attorney, Agent, or Firm* — MARSHALL, GERSTEIN & BORUN LLP

(57) ABSTRACT

A copper powder containing copper particles, wherein the copper powder has a packed bulk density of 1.30 g/cm$^3$ to 2.96 g/cm$^3$, and wherein a 50% particle diameter D50 when a cumulative frequency is 50% in a volume-based particle diameter histogram of the copper particles, and a crystallite diameter D determined from a diffraction peak of a Cu (111) plane in an X-ray diffraction profile obtained by powder X-ray diffractometry of the copper powder using Scherrer's formula satisfies D/D50≥0.060.

3 Claims, 2 Drawing Sheets

(52) U.S. Cl.
CPC ..... *B22F 2304/052* (2013.01); *B22F 2998/10* (2013.01)

(56) References Cited

U.S. PATENT DOCUMENTS

| | | | | |
|---|---|---|---|---|
| 2017/0253750 | A1* | 9/2017 | Okada | B22F 1/17 |
| 2018/0051176 | A1* | 2/2018 | Okada | C25C 1/12 |
| 2018/0111190 | A1* | 4/2018 | Okada | B22F 1/06 |
| 2020/0122236 | A1* | 4/2020 | Yoshida | B22F 1/05 |

FOREIGN PATENT DOCUMENTS

| | | | |
|---|---|---|---|
| JP | 2017-039990 | A | 2/2017 |
| JP | 6563617 | B1 | 8/2019 |
| JP | 2020-050947 | A | 4/2020 |
| JP | 2020180328 | A | 11/2020 |

OTHER PUBLICATIONS

Search Report in International Application No. PCT/JP2022/006770 dated Mar. 22, 2022, 4 pages.
"Materials on Mastersizer 3000", Mastersizer 3000 from Malvern, retrieved from the internet, 2017, https://www.atascientific.com.au/wp-content/uploads/2017/01/MRK1872, 20 pages.
Marković et al., "Effect of Particle Shape and Size of Copper Powders on the Properties of Sintered Parts", JST&M, vol. 4, 2023, pp. 22-29.
Chang et al., "Effects of Particle Shape and Temperature on Compaction of Copper Powder at Micro Scale", MATEC Web of Conferences, 123,00011, 2017, 6 pages.
Office Action in DE Application No. 11 2022 002 011.3 dated Jul. 31, 2026, 12 pages.

* cited by examiner

[Fig 1]
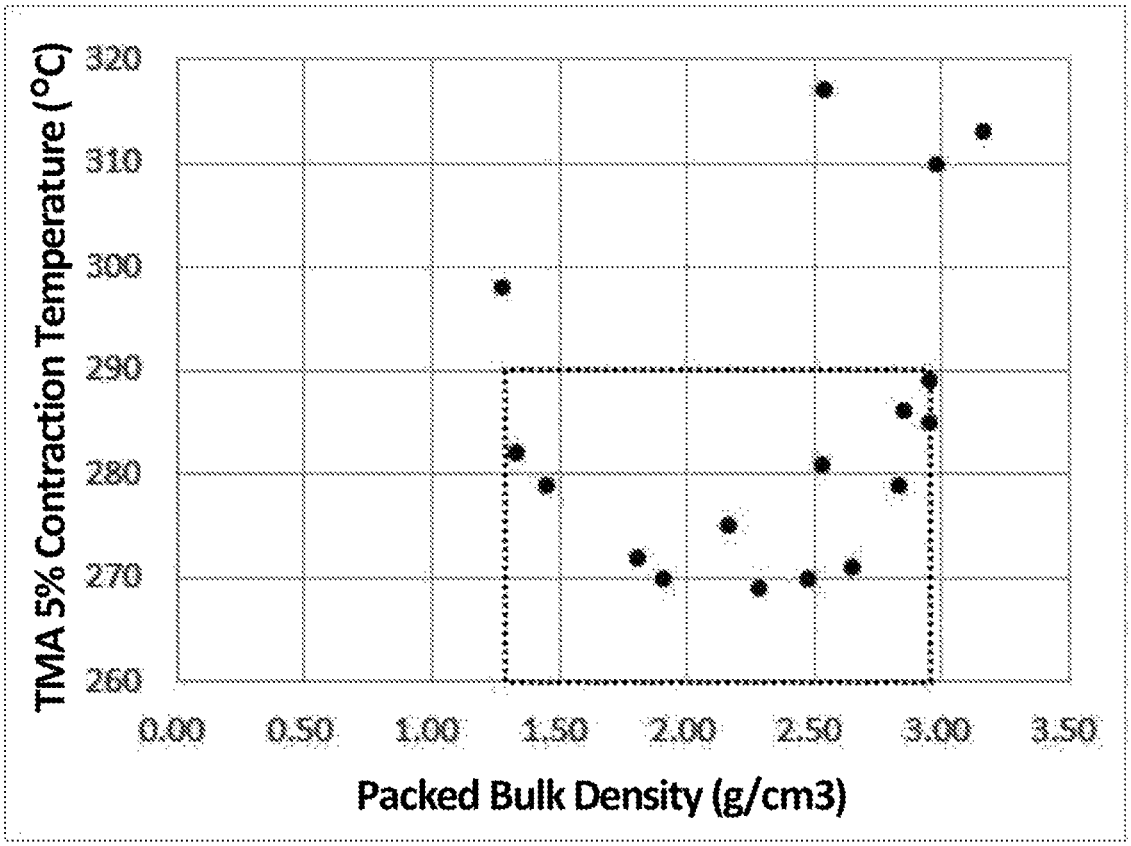

[Fig. 2]
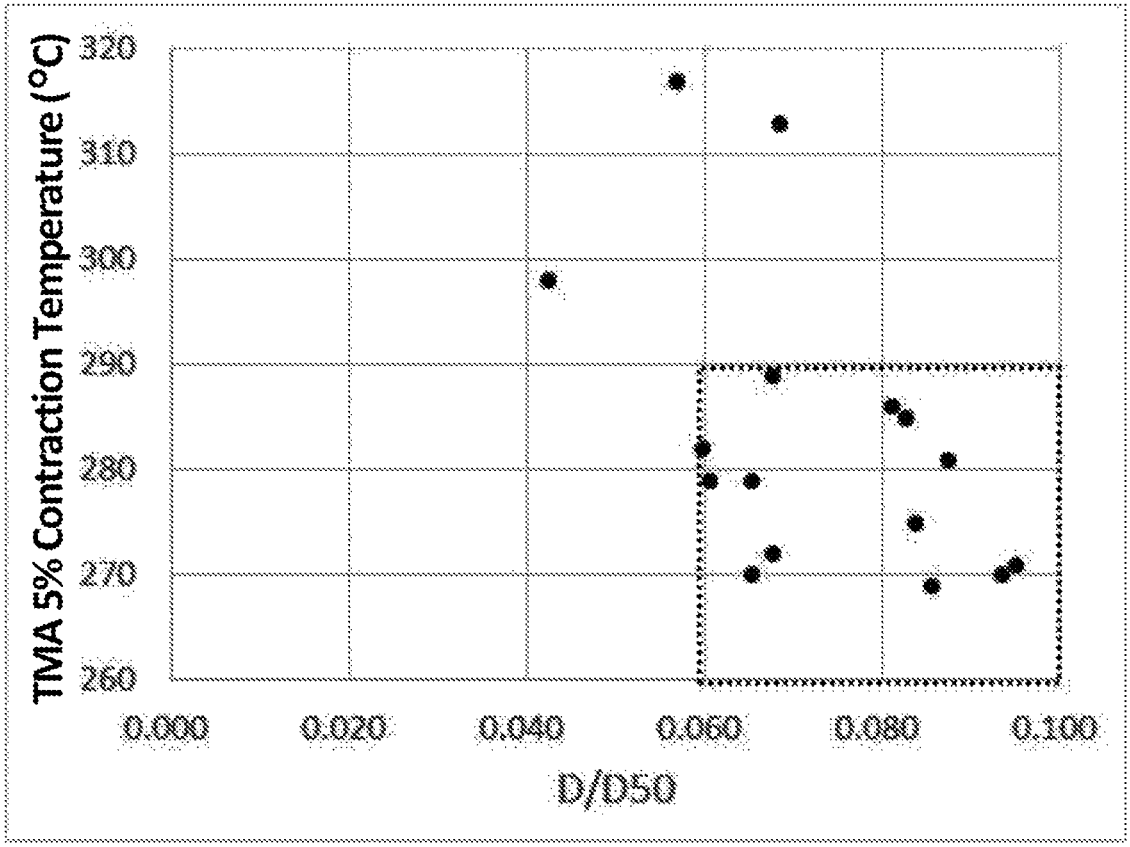

COPPER POWDER

TECHNICAL FIELD

This specification discloses an art relating to a copper powder.

BACKGROUND ART

Conductive pastes containing copper powder and used for forming circuits on substrates by printing or bonding semiconductor devices to the substrates include sintering-type pastes in which copper particles making up the copper powder are sintered by heating upon use.

The sintering type conductive pastes require the copper powder being sintered by heating at a relatively low temperature. This is because if the temperature during heating is high, the heat may affect the substrates and semiconductor devices. There is also a concern that large thermal stresses may be generated in the substrates or semiconductor devices during cooling after heating at a high temperature, which may alter electrical characteristics of the circuits or semiconductor devices.

In this regard, the Patent Literature 1 discloses "a conductive coating material for bonding a semiconductor device to a substrate, the conductive coating material comprising a metal powder, a non-heat curable resin, and a dispersing medium, wherein a shear stress of a shear rate in a range of 0.01 to 100 [s] at 2.5° C. increases monotonically with the shear rate, and the metal powder has a bulk density of less than 3 [g/cm$^3$]", for the purpose of "providing a conductive coating material capable of obtaining a sufficient bonding strength even if large-area members can be bonded at a relatively low temperature".

Patent Literature 2 describes "a copper powder comprising a plurality of copper particles, wherein a particle diameter D50 when a cumulative frequency in a volume-based particle diameter histogram of the plurality of copper particles is 50% is more than or equal to 100 nm and less than or equal to 500 nm, and wherein a ratio D/D50 of an average crystallite diameter D of the plurality of copper particles to the D50 is more than or equal to 0.10 and less than or equal to 0.50.

CITATION LIST

Patent Literature

[PTL 1]
Japanese Patent No. 6563617 B
[PTL 2]
Japanese Patent Application Publication No. 2020-180328 A

SUMMARY OF INVENTION

Technical Problem

Although various research and development efforts have proceeded for low-temperature sintering of copper powder, there are cases where sintering at even lower temperature is required.

This specification discloses a copper powder having improved low-temperature sintering properties.

Solution to Problem

The copper powder disclosed in this specification comprises copper particles, wherein the copper powder has a packed bulk density of 1.30 g/cm$^3$ to 2.96 g/cm$^3$, and wherein a 50% particle diameter D50 when a cumulative frequency is 50% in a volume-based particle diameter histogram of the copper particles, and a crystallite diameter D determined from a diffraction peak of a Cu (111) plane in an X-ray diffraction profile obtained by powder X-ray diffractometry of the copper powder using Scherrer's formula satisfies D/D50≥0.060.

Advantageous Effects of Invention

The copper powder as described above has improved low-temperature sintering properties.

BRIEF DESCRIPTION OF DRAWINGS

FIG. 1 shows a graph illustrating a relationship between a packed bulk density and a TMA 5% contraction temperature of a copper powder in each of Examples.

FIG. 2 shows a graph illustrating a relationship between D/D50 and a TMA 5% contraction temperature of a copper powder in each of Examples.

DESCRIPTION OF EMBODIMENTS

Hereinafter, embodiments of the copper powder as described above will be described in detail.

A copper powder according to an embodiment contains copper particles, wherein the copper powder has a packed bulk density of 1.30 g/cm$^3$ to 2.96 g/cm$^3$, and wherein a 50% particle diameter D50 when a cumulative frequency is 50% in a volume-based particle diameter histogram of the copper particles, and a crystallite diameter D calculated from a diffraction peak of a Cu (111) plane in an X-ray diffraction profile obtained by powder X-ray diffractometry of the copper powder using Scherrer's formula satisfies D/D50≥0.060.

As shown in the section of Examples, we have newly found that a temperature at which a coefficient of linear contraction by thermo-mechanical analysis (TMA) reaches 5% is effectively lowered if the copper powder has a packed bulk density of 1.30 g/cm$^3$ to 2.96 g/cm$^3$ and D/D50≥0.060. The temperature at 5% coefficient of linear contraction in thermo-mechanical analysis means the temperature at which the sintering of the copper powder progresses and the electrical resistance drops to some extent. Therefore, the copper powder having a low temperature at 5% coefficient of linear contraction in thermo-mechanical analysis can be considered to be sufficiently sintered at such a low temperature and to have improved low-temperature sintering properties.

When the D/D50 is less than 0.060 even if the packed bulk density is in the range of 1.30 g/cm$^3$ to 2.96 g/cm$^3$, or when the packed bulk density is out of the range of 1.30 g/cm$^3$ to 2.96 g/cm$^3$ even if the D/D50 is greater than 0.060, the temperature at 5% coefficient of linear contraction in the thermomechanical analysis is higher to some extent, and the desired low-temperature sintering properties cannot be achieved. The copper powder according to this embodiment has a packed bulk density of 1.30 g/cm$^3$ to 2.96 g/cm$^3$ and D/D50≥0.060, which means that it has improved low-temperature sintering properties.

(Packed Bulk Density)

The packed bulk density of the copper powder is 1.30 g/cm$^3$ to 2.96 g/cm$^3$. If the ratio of the crystallite diameter D to the 50% particle diameter D50 (D/D50) is greater than 0.060 and the packed bulk density is in this range, the temperature at which the coefficient of linear contraction by thermomechanical analysis reaches 5% is sufficiently low, i.e., 290° C. or less.

With regard to the packed bulk density of the copper powder, as described in Patent Literature 1 as described above, it was believed that a lower packed bulk density would result in superior low-temperature sintering properties. However, as shown in the section of Examples, in the case of the ratio D/D50≥0.060, the sintering temperature decreases as the packed bulk density decreases until it reaches about 2.00 g/cm$^3$, but the sintering temperature increases when the packed bulk density becomes lower that that value, and in particular, when the packed bulk density is below 1.30 g/cm$^3$, the sintering temperature may increase rapidly. The sintering temperature also increases significantly when the packed bulk density is higher than 2.96 g/cm$^3$.

Based on such findings, the packed bulk density should be 1.30 g/cm$^3$ to 2.96 g/cm$^3$, preferably 1.80 g/cm$^3$ to 2.80 g/cm$^3$.

To measure the packed bulk density, for example, using the Powder Tester PT-X manufactured by Hosokawa Micron Corporation, a 10 cc cup with a guide attached is filled with the copper powder and tapped 1000 times. The guide is then removed, the portion of the cup that exceeds the volume of 10 cc is slid off, and the weight of the copper powder in the cup is measured. This weight can be used to determine the packed bulk density.

(Ratio of Crystallite Diameter to 50% Particle Diameter)

A ratio of a crystallite diameter D to a 50% particle diameter D50 of the copper powder (D/D50) should be 0.060 or more. When the packed bulk density is in the predetermined range as described above, The D/D50 of 0.060 or more is sufficient to lower the sintering temperature.

A copper powder having a D/D50 of less than 0.060 even if the packed bulk density is in the predetermined range as described above cannot achieve the low-temperature sintering properties that the temperature when the coefficient of linear contraction in thermo-mechanical analysis reaches 5% is 290° C. or less. In this regard, the ratio D/D50 is preferably 0.065 or more. The ratio D/D50 may be from 0.065 to 0.095.

The 50% particle diameter D50 means a particle diameter in which the cumulative volume-based frequency of the copper particles is 50% in a particle diameter histogram (particle diameter distribution graph) obtained by measuring the particle diameters of the copper particles in the copper powder using a laser diffraction/scattering particle diameter distribution analyzer, and it is measured according to JIS Z8825 (2013). More particularly, for the measurement of the 50% particle diameter D50, MASTERSIZER 3000 from Malvern can be used, under conditions of a dispersant: an aqueous sodium hexametaphosphate solution; optical parameters: a particle absorption of 5.90, a particle absorption (blue) of 0.92, a particle refractive index of 3.00, a particle refractive index (blue) of 0.52; and a scattering intensity: 6-8%.

The crystallite diameter D means an average diameter of crystallites that can be regarded as monocrystals, and is determined using the Scherrer's formula from a diffraction peak in a Cu (111) plane in an X-ray diffraction profile obtained by powder X-ray diffractometry for the copper powder. To determine the crystallite diameter, the analysis software PDXL2 can be used with RINT-2200Ultima from Rigaku Corporation under conditions of CuKα radiation, an acceleration voltage of 45 KV, and 200 mA.

(BET Specific Surface Area)

The copper powder preferably has a BET specific surface area of 0.5 m$^2$/g and 10.0 m$^2$/g. If the BET specific surface area is more than 10.0 m$^2$/g, it is difficult to guarantee oxidation resistance, and problems may arise with paste characteristics due to moisture absorption, agglomeration and the like. On the other hand, if the BET specific surface area is less than 0.5 m$^2$/g, the particle diameter of the copper powder is larger, so that a circuit or bonding surface printed with the paste may not be sufficiently smooth. From this viewpoint, the BET specific surface area of the copper powder is preferably 0.5 m$^2$/g to 10.0 m$^2$/g, and even more preferably 2.0 m$^2$/g to 7.0 m$^2$/g.

To measure the BET specific surface area of the copper powder, the copper powder can be degassed in a vacuum at a temperature of 70° C. for 5 hours, and then measured in accordance with JIS Z8830: 2013, for example, using BELSORP-mini II from Microtrac Bell.

(Carbon Content)

The copper powder preferably has a carbon content of 0.50% by mass or less, even 0.30% by mass or less, especially 0.15% by mass or less. This is because if the carbon content is higher, the solid carbon remaining during sintering may hinder sintering.

The carbon content is measured by the high frequency induction furnace combustion-infrared absorption method. Specifically, the carbon content of the copper powder can be measured using a carbon-sulfur analyzer such as LECO Model CS844, using LECO LECOCEL II and Fe chips as auxiliary combustion agents and steel pins as a calibration curve.

(Hydrogen Reduction Loss)

The hydrogen reduction loss of the copper powder can be measured as a decrease in weight when the copper powder is heated at 800° C. for 10 minutes or more in an atmosphere containing 2% by volume to 100% by volume of hydrogen. If the hydrogen reduction loss is higher, it is considered that the copper particles in the copper powder are being oxidized, so that sintering may be difficult to proceed. Therefore, it is preferable that the hydrogen reduction loss of the copper powder is less than 1.5%, particularly less than 1.0%.

(Low-Temperature Sintering Properties)

The above copper powder is capable of sintering the copper particles contained therein at a relatively low temperature. The low-temperature sintering properties can be confirmed as follows. About 0.3 g of copper powder is filled into a cylindrical mold with a diameter of 5 mm, and then uniaxially pressured to produce a cylindrical compact pellet having a height of about 3 mm and a density of 4.7±0.1 g/cc. Subsequently, using a thermo-mechanical analyzer (TMA), the temperature of the above compact pellet is increased from 25° C. at a rate of 10° C./min in an atmosphere containing 2% by volume of hydrogen ($H_2$), the balance being nitrogen ($N_2$). In this case, as the temperature is increased, the copper particles making up the compact pellet is sintered and the volume of the compact pellet is decreased to approach the density of metal copper (about 8.9 g/cm$^3$). If the rate of change in the cylinder height in a contraction direction of such a compact pellet is called a coefficient of linear contraction, it can be evaluated that as the temperature at which this coefficient of linear contraction reaches 5% is lower, the copper powder has improved low temperature sintering properties. In particular, the temperature at which the above coefficient of linear contraction reaches 5% is preferably 350° C. or less.

(Production Method)

The copper powder as described above can be produced, for example, by using a chemical reduction method or a disproportionation method. The production of the copper powder is not limited to these methods, but the details of the chemical reduction method are as follows.

In the case of the chemical reduction method, for example, the following steps are performed in this order: a step of preparing an aqueous copper salt solution, an aqueous alkali solution, an aqueous reducing agent solution, and the like, as raw material solutions; a step of mixing and reacting these raw material solutions to obtain a slurry containing copper particles; a step of washing the copper particles; a step of performing solid-liquid separation; a step of drying it; and an optional step of crushing it.

In one more specific example, after the aqueous copper sulfate solution is heated to an appropriate reaction temperature and the pH is then adjusted with an aqueous sodium hydroxide solution or an aqueous ammonia solution, an aqueous hydrazine solution is then added at once to carry out the reaction, and reduce the copper sulfate to cuprous oxide particles with a particle diameter of about 100 nm. After the slurry containing cuprous oxide particles is heated to the reaction temperature, an aqueous solution containing sodium hydroxide and hydrazine is added dropwise, followed by a subsequent drop of an aqueous hydrazine solution to reduce the cuprous oxide particles to copper particles. At the end of the reaction, the resulting slurry is filtered, then washed with pure water and methanol, and further dried. The copper powder is thus obtained.

The reducing agent such as hydrazine added to the aqueous copper sulfate solution is used to reduce divalent copper to monovalent copper (cuprous oxide). Then, when the reducing agent is added at once, the cuprous oxide particles thus produced tend to be fine, as described above. After relatively fine cuprous oxide particles have been generated, the reducing agent can be added separately. After the formation of cuprous oxide particles, the reducing agent added in the first addition can be mainly used for the formation of metal copper nuclei, and the reducing agent added in the second addition can be used for the growth of those metal copper nuclei. As a result, the packed bulk density and the ratio of crystallite diameter to the 50% particle diameter of the copper powder tend to be suitably controlled.

In the above production, an aqueous solution of copper sulfate or nitrate can be used as the aqueous copper salt solution. The aqueous alkali solution may specifically be an aqueous solution of NaOH, KOH or $NH_4OH$, or the like. The reducing agent in the aqueous reducing agent solution includes an organic substance such as sodium borohydride or glucose, in addition to hydrazine.

If necessary, an organic substance such as complexing agents and dispersants may be added during the process of producing the copper powder. For example, gelatin, ammonia, gum arabic, or the like can be added one or more times between the step of preparing the raw material solution and the step of obtaining the slurry containing the copper particles.

(Use)

The copper powder thus produced is particularly suitable for use, for example, in conductive pastes that can be mixed with resin materials and dispersion media to form a paste and used for bonding semiconductor devices to substrates and forming wiring.

EXAMPLES

Next, the copper powder as described above was experimentally produced and the effects thereof were confirmed, as described below. However, the descriptions herein are merely illustrative and are not intended to be limited thereto.

Example 1

First, an aqueous solution of 2400 g of copper sulfate pentahydrate and 30 g of citric acid dissolved in 8.7 L of pure water was mixed with 6.7 L of a mixed solution of 540 g of sodium hydroxide and 144 g of hydrazine monohydrate at once to synthesize a slurry containing cuprous oxide nanoparticles (average particle diameter of about 100 nm). After heating the slurry with suspended cuprous oxide particles at a temperature of 50° C. or more, 4.5 L of a mixed aqueous solution of 43 g of hydrazine monohydrate and 409 g of sodium hydroxide was added dropwise, and the pH was adjusted by adding sodium hydroxide solution, and 1.3 L of an aqueous solution of 101 g of hydrazine monohydrate was then added dropwise. At the end of the reaction, the product was repeatedly decanted, washed with water, dried, and crushed to obtain a copper powder.

Examples 2 and 3

The process was the same as that of Example 1 until a slurry containing cuprous oxide was synthesized. Then, 4.5 L of a mixed aqueous solution of 29 g of hydrazine monohydrate and 409 g of sodium hydroxide was added dropwise, and the pH was then adjusted, and 1.3 L of an aqueous solution of 115 g of hydrazine monohydrate was further added dropwise to reduce cuprous oxide to metal copper, which was washed, dried and crushed in the same manner.

Examples 4 and 5

The process was the same as that of Example 1 until a slurry containing cuprous oxide was synthesized. Then, 4.5 L of a mixed aqueous solution of 43 g of hydrazine monohydrate and 409 g of sodium hydroxide was added dropwise, the pH was then adjusted, and 1.3 L of an aqueous solution of 101 g of hydrazine monohydrate was further added dropwise to reduce cuprous oxide to metal copper, which was washed, dried, and crushed in the same manner.

Examples 6, 10, and 11

The process was the same as that of Example 1 until a slurry containing cuprous oxide was synthesized. Then, 4.5 L of a mixed aqueous solution of 72 g of hydrazine monohydrate and 409 g of sodium hydroxide was added dropwise, the pH was then adjusted, and 1.3 L of an aqueous solution of 72 g of hydrazine monohydrate was further added dropwise to reduce cuprous oxide to metal copper, which was washed, dried, and crushed in the same manner.

Example 7

A Copper powder was obtained by substantially the same method as that of Example 2, with the exception that after cuprous oxide was reduced to metal copper, washing was carried out by repeating the solid-liquid separation using membrane filtration.

Example 8

The process was the same as that of Example 1 until a slurry containing cuprous oxide was synthesized. Then, 4.5 L of a mixed aqueous solution of 101 g of hydrazine monohydrate and 409 g of sodium hydroxide was added dropwise, and the pH was then adjusted, and 1.3 L of an aqueous solution of 43 g of hydrazine monohydrate was further added dropwise to reduce cuprous oxide to metal copper, which was washed, dried and crushed in the same manner.

Example 9

The process was the same as that of Example 1 until a slurry containing cuprous oxide was synthesized. Then, 4.5 L of a mixed aqueous solution of 72 g of hydrazine monohydrate and 409 g of sodium hydroxide was added dropwise, and the pH was then adjusted, and 1.3 L of an aqueous solution of 72 g of hydrazine monohydrate was further added dropwise to reduce cuprous oxide to metal copper, which was washed, dried, and crushed in the same manner.

Examples 12 and 13

The process was the same as that of Example 1 until a slurry containing cuprous oxide was synthesized. Then, 4.5 L of a mixed aqueous solution of 72 g of hydrazine monohydrate and 409 g of sodium hydroxide was added dropwise, and the pH was then adjusted, and 1.3 L of an aqueous solution of 72 g of hydrazine monohydrate was further added dropwise to reduce cuprous oxide to metal copper, which was washed, dried and crushed in the same manner.

Comparative Example 1

First, an aqueous solution of 500 g of copper sulfate pentahydrate and 6 g of citric acid dissolved in 1.8 L of pure water was mixed with 1.3 L of a mixed aqueous solution of 113 g of sodium hydroxide and 30 g of hydrazine monohydrate at once to synthesize a slurry containing cuprous oxide nanoparticles (average particle diameter of about 100 nm). After heating the slurry with suspended cuprous oxide particles at a temperature of 50° C. or more, 0.5 L of a mixed aqueous solution of 3 g of hydrazine monohydrate and 55 g of sodium hydroxide was added dropwise, the pH was adjusted by adding sodium hydroxide solution, and 0.28 L of an aqueous solution of 27 g of hydrazine monohydrate was then added dropwise. At the end of the reaction, the product was repeatedly decanted, washed with water, dried, and crushed to obtain a copper powder.

Comparative Example 2

The process was the same as that of Comparative Example 1 until a slurry containing cuprous oxide was synthesized. Then, 4.5 L of a mixed aqueous solution of 14.4 g of hydrazine monohydrate and 409 g of sodium hydroxide was added dropwise, and the pH was then adjusted, and 1.3 L of an aqueous solution of 129.6 g of hydrazine monohydrate was further added dropwise to reduce cuprous oxide to metal copper, which was washed, dried and crushed in the same manner.

Comparative Example 3

After reducing cuprous oxide to metal copper under the same conditions as those of Comparative Example 2, 2 L of an aqueous solution containing 0.3 g of malonic acid was added to 600 g of the copper particles, and stirred at 350 rpm for 60 minutes at room temperature, and washed and dried to produce a copper powder.

EVALUATION

The packed bulk density, 50% particle diameter, crystallite diameter, BET specific surface area, hydrogen reduction loss, carbon content, and temperature at which the coefficient of linear contraction reaches 5% by thermo-mechanical analysis (TMA) were measured for each of the above copper powders according to Examples 1 to 13 and Comparative Examples 1 to 4 in accordance with the method as described above. The results are shown in Table 1. The crystallite diameter of the copper powder in Comparative Example 3 is unknown because it was not measured. The relationship between the packed bulk density and the TMA 5% contraction temperature of each copper powder and the relationship between the D/D50 and the TMA 5% contraction temperature are graphically shown in FIGS. 1 and 2, respectively.

TABLE 1

| | Packed Bulk Density ($g/cm^3$) | 50% Particle Diameter D50(nm) | Crystallite Diameter D(nm) | D/D50 | BET ($m^2/g$) | Hydrogen Reduction Loss (%) | Carbon Content (%) | TMA 5% Contraction Temperature (° C.) |
|---|---|---|---|---|---|---|---|---|
| Ex. 1 | 2.96 | 0.652 | 44.1 | 0.068 | 2.30 | 0.5 | 0.08 | 269 |
| Ex. 2 | 2.95 | 0.586 | 48.4 | 0.083 | 2.38 | 0.6 | 0.08 | 265 |
| Ex. 3 | 2.85 | 0.585 | 47.5 | 0.081 | 2.50 | 0.5 | 0.07 | 266 |
| Ex. 4 | 2.83 | 0.702 | 45.8 | 0.065 | 2.58 | 0.5 | 0.08 | 279 |
| Ex. 5 | 2.47 | 0.486 | 45.4 | 0.093 | 2.78 | 0.6 | 0.08 | 270 |
| Ex. 6 | 2.65 | 0.495 | 47 | 0.095 | 2.86 | 0.6 | 0.08 | 271 |
| Ex. 7 | 2.53 | 0.551 | 48.2 | 0.087 | 2.90 | 1.0 | 0.08 | 281 |
| Ex. 8 | 1.45 | 0.660 | 39.9 | 0.060 | 4.49 | 1.0 | 0.13 | 279 |
| Ex. 9 | 1.33 | 0.635 | 37.9 | 0.060 | 5.16 | 1.2 | 0.15 | 282 |
| Ex. 10 | 1.81 | 0.639 | 43.2 | 0.068 | 3.71 | 0.8 | 0.12 | 272 |
| Ex. 11 | 1.91 | 0.661 | 43.2 | 0.065 | 3.44 | 0.7 | 0.11 | 270 |
| Ex. 12 | 2.16 | 0.542 | 45.4 | 0.084 | 3.36 | 0.7 | 0.10 | 275 |
| Ex. 13 | 2.28 | 0.524 | 44.8 | 0.085 | 3.31 | 0.7 | 0.09 | 269 |
| Comp. 1 | 3.16 | 0.726 | 49.8 | 0.069 | 1.90 | 0.5 | 0.05 | 313 |
| Comp. 2 | 2.54 | 0.716 | 40.8 | 0.057 | 2.30 | 0.7 | 0.07 | 317 |
| Comp. 3 | 2.98 | 0.723 | NA | NA | 2.03 | 0.6 | 0.19 | 310 |
| Comp. 4 | 1.28 | 0.873 | 37.1 | 0.042 | 5.22 | 1.4 | 0.15 | 298 |

It is found from Table 1 that Examples 1 to 13, which have a packed bulk density of 1.30 g/cm$^3$ to 2.96 g/cm$^3$ and D/D50≥0.060, have a sufficiently lower TMA 5% contraction temperature of 290° C. or less, that that of Comparative Examples 1 to 4 that do not fulfill any one of these conditions.

According to the graph shown in FIG. 1, it is also found that the lowest sintering temperature is achieved when the packed bulk density is around 2.00 g/cm$^3$. When the packed bulk density is in the range of 1.30 g/cm$^3$ to 2.96 g/cm$^3$, there is a quadratic tendency for the sintering temperature to gradually increase as the packed bulk density increases or decreases from around 2.00 g/cm$^3$. On the other hand, when the packed bulk density is outside of the above range, the sintering temperature increases significantly and rapidly. However, even if the packed bulk density is in the range of 1.30 g/cm$^3$ to 2.96 g/cm$^3$, the sintering temperature is higher in Comparative Example 2 where the D/D50 is less than 0.060.

It is found that all of the copper powders according to Examples 1 to 13, where the packed bulk density was in the range of 1.30 g/cm$^3$ to 2.96 g/cm$^3$, had the D/D50 of 0.060 or more, as shown in FIG. 2, indicating that they resulted in lower sintering temperatures.

In view of the foregoing, it is found that the above copper powders have improved low temperature sintering properties.

The invention claimed is:

1. A copper powder comprising copper particles, wherein the copper powder has a packed bulk density of 1.30 g/cm$^3$ to 2.96 g/cm$^3$, and wherein a 50% particle diameter D50 when a cumulative frequency is 50% in a volume-based particle diameter histogram of the copper particles, and a crystallite diameter D determined from a diffraction peak of a Cu (111) plane in an X-ray diffraction profile obtained by powder X-ray diffractometry of the copper powder using Scherrer's formula satisfies 0.065≤D/D50≤0.095, wherein the copper powder has a BET specific surface area of 2.0 m$^2$/g to 7.0 m$^2$/g, wherein the copper powder has a TMA 5% contraction temperature of 290° C. or less, and wherein the TMA 5% contraction temperature is a temperature at which a coefficient of linear contraction by thermo-mechanical analysis (TMA) reaches 5%.

2. The copper powder according to claim 1, wherein the copper powder has a carbon content of 0.50% by mass or less.

3. The copper powder according to claim 1, wherein the copper powder has a hydrogen reduction loss of 1.5% or less.

* * * * *